United States Patent [19]

Martin

[11] Patent Number: 4,480,356

[45] Date of Patent: Nov. 6, 1984

[54] DOUBLE-GRIP CLIP

[76] Inventor: Donald A. Martin, 1411 Dugdale, North Chicago, Ill. 60064

[21] Appl. No.: 540,635

[22] Filed: Oct. 11, 1983

Related U.S. Application Data

[63] Continuation-in-part of Ser. No. 309,457, Oct. 7, 1981.

[51] Int. Cl.[3] ..... B42F 1/02; A44B 21/00

[52] U.S. Cl. ..... 24/67.9; 24/67.3; 24/545; 24/547; 40/11 A; D19/65

[58] Field of Search ..... 24/67.9, 67 R, 67.3, 24/67.5, 545, 546, 547, 548, 551, 552, 561, 562; 40/11 A; D19/65

[56] References Cited

U.S. PATENT DOCUMENTS

| | | | |
|---|---|---|---|
| 751,531 | 2/1904 | Mayers | 24/547 |
| 802,262 | 10/1905 | Brooks | 24/547 |
| 1,447,409 | 3/1923 | Breeding | 132/50 R |
| 1,600,748 | 9/1926 | Bader | 24/547 |
| 1,654,076 | 12/1927 | Griffiths | 24/562 |
| 2,056,139 | 9/1936 | Kelly | 24/561 |
| 2,938,252 | 5/1960 | Scheemaeker | 24/547 |
| 3,123,924 | 3/1964 | Roberts | 24/547 |
| 3,290,751 | 12/1966 | Besnier | 24/67.3 |
| 3,913,181 | 10/1975 | Walker | 24/67.9 |
| 4,300,268 | 11/1981 | Wilson | 24/67.9 |

FOREIGN PATENT DOCUMENTS

| | | | |
|---|---|---|---|
| 1169889 | 5/1964 | Fed. Rep. of Germany | 24/67.9 |

*Primary Examiner*—Victor N. Sakran

*Attorney, Agent, or Firm*—Mathew R. P. Perrone, Jr.

[57] ABSTRACT

A double-grip, a one-piece clip is formed by having a single piece of wire being continuous and bent to form two gripping units on one side of the items desired to be gripped and two gripping units on the other side of the items desired to be gripped.

20 Claims, 3 Drawing Figures

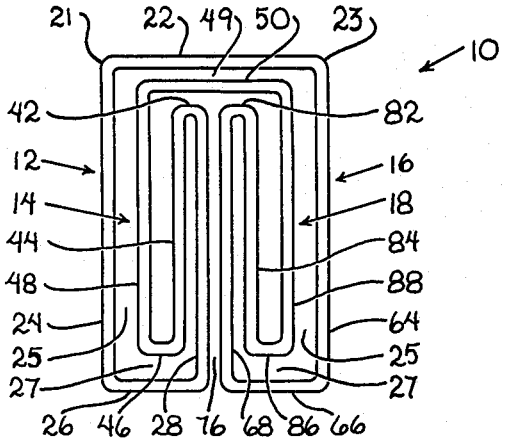
Fig. I
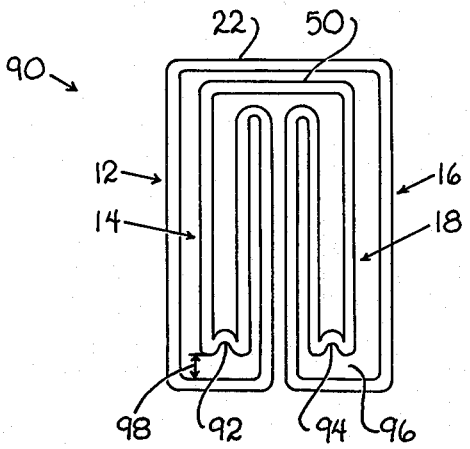
Fig. II
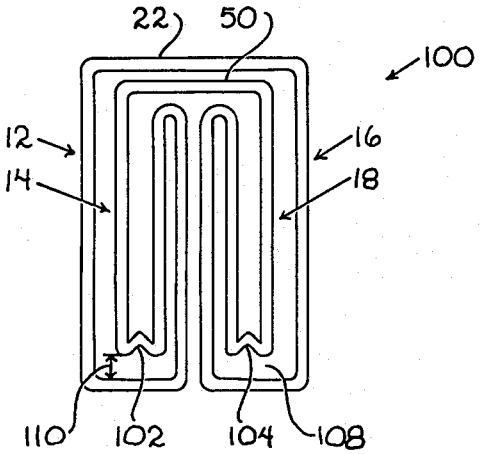
Fig. III

DOUBLE-GRIP CLIP

CROSS REFERENCE TO RELATED APPLICATION

This application is a continuation-in-part of Ser. No. 309,457 filed Oct. 7, 1981, by Donald A. Martin, the inventor of the clip disclosed and claimed in this application.

BACKGROUND OF INVENTION

This invention relates to a clip and more particularly to a clip for holding papers and similar material in a strong, heavily-supported relationship by providing at least two holding supports on either side of the material desired to be held. This clip is formed from a continuous piece of wire or similar material.

It is difficult to provide a removable holding device for securing papers, cloth, or similar material together on a temporary basis. It is sometimes extremely desirable to secure such material together strongly, yet provide an easy method of removing the clipping device.

The clipping device must have attributes of strong holding power, ease of construction, and ease of application and removal. These features are almost inherently contradictory. Ease of construction may well not produce desired strength. Having the desired strength may result in a clip which is difficult to produce. At the same time, the strength of holding combined with the ease of removal are contradictory. It is useful to have a device which can be applied, provide strong holding, and be easily removed.

Clips claiming to have these features are known in the art. However, clips of the prior art lack the balance required for ease of application and removal, and strength of holding. These clips suffer from a loss of clipping power because of the assimilated or extrapolated continuity in and with the crossovers of the wires involved. As the assimilated wire crosses over and bends to form the assimilated wire clipping fingers in the prior art, weakness of the holding power is the result. With this weakness in the holding power the desired results of holding strength are sacrificed for a somewhat ease of manufacture.

Other clipping devices provide only simplified weak gripping. Some devices may have two finger grips on one side of the page and one finger on the other side. Such a set up provides for weakness and does not provide the desired holding strength.

It is also desired to achieve a streamlined, readily-usable clip. However, the streamlining features detract from the strength of holding and simplicity of manufacture. These contradictory features clearly create problems in the art.

In one attempt to solve the clipping problem of the prior art, hanging, loose and blunt wire ends appear. The full 100% clipping power of the device is thereby lost. If the would-be connecting, but missing, members used to assimilate continuity from one blunt wire end to the opposite blunt wire end were to exist, the resulting extrapolated wires overlay or crossover each other—thereby holding the clipping fingers in the partially opened position and greatly weakening the prior art device.

It thus becomes clear that it is highly desirable to have a one-piece, wire or similar material unit which is a self-contained, continuous, endless flow device for the purpose of holding papers and other materials.

SUMMARY OF THE INVENTION

Therefore, it is an object of this invention to provide a clip with strong holding power.

A still further object of this invention is to provide a clip capable of being easily applied.

Yet a further object of this invention is to provide a clip capable of being easily removed.

Also an object of this invention is to provide a clip capable of being easily manufactured.

Another object of this invention is to provide a clip capable of having a strong holding power.

These and other objects of the invention are formed by having a one-piece clip made out of wire or similar material capable of holding its shape, having a continuous, endless flow of wire or similar material from the beginning and forming holders such that there are two holders on one side of the item or items being held and two on the other side.

BRIEF DESCRIPTION OF THE DRAWING

FIG. I relates to a double-grip, flat clip 10.

FIG. II relates to a double-grip, circle clip 90.

FIG. III relates to a double-grip, triangle clip 100.

Throughout the figures of the drawing where the same part appears in more than one figure thereof, the same number is applied thereto.

DESCRIPTION OF THE PREFERRED EMBODIMENTS

A double-grip clip is formed by having a single piece of wire being continuous and bent to form two gripping units on one side of the items desired to be gripped and two gripping units on the other side of the items desired to be gripped.

Referring now to FIG. I, continuous double-grip, flat clip 10 includes a first outer grip 12 and a first inner grip 14 coplanar therewith and interior to first outer grip 12. Also included in clip 10 as an integral part thereof are second outer grip 16 and second inner grip 18. First outer grip 12, first inner grip 14, second outer grip 16, and second inner grip 18 are substantially coplanar.

First outer grip 12 is a mirror image of second outer grip 16. Also first inner grip 14 is a mirror image of second inner grip 18. First outer grip 12 and second outer grip 16 generally form the two gripping units on one side of the items desired to be gripped, while first inner grip 14 and second inner grip 18 are generally on the opposing side thereof. Other combinations may, however be used.

First outer grip 12 and second outer grip 16 are joined by flat top 22. Flat top 22 basically forms for purposes of definition the top of continuous dual grip 10.

Flat top 22, first outer device side 24, first outer base 26, and first interior arm 28 are substantially coplanar and make up first outer grip 12. First outer device side 24 is substantially perpendicular to flat top 22. First outer base 26 is oppositely disposed from flat top 22 and substantially parallel thereto. Flat top 22, first outer device side 24 and first outer base 26 are continuous, because they are made of the same continuous wire or other material used to make double-grip, flat clip 10.

By continuing along the wire, substantially perpendicular to first outer base 26 is first interior arm 28. First interior arm 28 is also oppositely disposed from first outer device side 24. First inner grip 14 includes first inner leg 44 connected to first interior arm 28 by first inner arc 42. First inner leg 44 is substantially parallel and adjacent to first interior arm 28.

Substantially perpendicular to first inner leg 44 and oppositely disposed from first inner arc 42 is first inner base 46. Substantially perpendicular to first inner base 46 and oppositely disposed from first inner leg 44 is first inner side 48. First inner leg 44, first inner base 46, and first inner side 48, are continuous. First inner side 48 continues up to first inner top 50. First inner top 50 connects second inner grip 18 with first inner grip 14.

Flat top 22 extends from first outer device side 24 and ends in second outer device side 64. Second outer device side 64 is substantially perpendicular to flat top 22 and substantially parallel to first outer device side 24. First outer device side 24 and second outer device side 64 are the outside edge of the clip 10.

Oppositely disposed from flat top 22 is a continuing part of second outer device side 64 is second outer base 66. Second outer base 66 is perpendicular to second outer device side 64.

Oppositely disposed from second outer device side 64 and perpendicular to second outer base 66 is second interior arm 68. Thus, second interior arm 68 is substantially parallel to second outer device side 64. This structure indicates that first outer grip 12 and second outer grip 16 are substantially mirror images of each other.

As a continuation of second interior arm 68 and oppositely disposed to second outer base 66 is second inner arc 82. Second inner arc 82 continues to form second inner leg 84. Second inner leg 84 is between second outer device side 64 and second interior arm 68.

Second inner base 86 is a continuation of second inner leg 84 and is oppositely disposed from inner top 50. Inner top 50 and second inner base 86 are substantially parallel to each other. Substantially perpendicular to second inner base 86 and between second inner leg 84 and second outer device side 64 is second inner side 88. In this fashion, a substantially continuous clip with dual grips is achieved.

At each end of flat top 22 the structure is similar. At one end of flat top 22 there is a first outer leg 24. Oppositely disposed from first outer leg 24 on the other end of flat top 22 is a second outer leg 64. First outer leg 24 is extended from flat top 22 at a first top end 21. Second outer leg 64 is extended from flat top 22 at second top end 23. First outer leg 24 and second outer leg 64 are substantially perpendicular to flat top 22 with only a slight arc connecting therebetween.

Referring now to FIG. II, wherein dual grip circle clip 90 is shown, the structure as compared to dual grip flat clip 10 is substantially similar. The basic difference between dual grip circle clip 90 and dual grip flat clip 10 is the use of first base arc 92 to replace first inner base 46 and second base arc 94 to replace second inner base 86. This feature is accomplished by merely bending the wire in arcuate shape inwardly toward inner top 50. Both first arc 92 and second arc 94 are substantially coplanar with the first outer grip 12, first inner grip 14, second outer grip 16, and second inner grip 18.

Referring now to FIG. III, wherein dual grip triangular clip 100 is shown, it can be seen that dual grip triangular clip 100 is substantially similar to dual grip flat clip 10 but for the fact that first based triangle replaces first inner base 46 and second base triangle replaces second inner base 86. Like first arc 92 and second arc 94, first base triangle 102 and second base triangle 104 are inwardly directed toward inner top 50. In all other respects, triangle clip 100 is similar to dual grip flat clip 10.

First outer device side 24 is oppositely disposed from second outer device side 64. Adjacent first outer device side 24 is first inner side 48. Oppositely disposed from first outer side 24 and first inner side 48 is first inner leg 44. Adjacent first inner leg 44 and opposite disposed from first inner side 48 is first interior arm 28. Adjacent first interior arm 28 is second interior arm 68. Second interior arm 68 is of course oppositely disposed from first inner leg 44. Between second interior arm 68 and first interior arm 28 is a space 76.

Between second interior arm 68 and second inner side 88, is second inner leg 84. Second inner side 88 is of course, between second outer side 64 and second inner leg 84.

Circle clip 90 and triangle clip 100 are similarly structured but for the presence of first base arc 92, second base arc 94, first base triangle 102 and second base triangle 104.

It is clear that first base arc 92, second base arc 94, first base triangle 102 and second base triangle 104 provide for a gripping means to assist the release or application of arc clip 90 or triangle clip 100 respectively.

For all of FIGS. I, II, and III, flat top 22 is adjacent to and separated from inner top 50 by top space 49. In fact, a preferred dual-grip clip 10, circle clip 90, and triangular clip 100 have top space 49 up to about twice the cross-section of the wire used to make dual-grip flat clip 10, circle clip 90, and triangular clip 100. More preferrably, top space 49 is about 0.5 to about 1.5 times the cross-section of the wire used. Most preferrably, top space 49 is about equal to the cross-section of the wire used.

Interior arm space 76, between first interior arm 28 and second interior arm 68 has measurements similar to top space 49.

Oppositely disposed from flat top 22 and on the other side of inner top 50 are first outer base 26 and second outer base 66. In flat clip 10, first outer base 26 is preferrably separated from first inner base 46 by base space 27. Preferrably base space 27 is up to about five times the cross-section of the wire used to make dual-grip flat clip 10. More preferrably, base space 27 is about 1 to about 4 times the cross-section of the wire used. Most preferrably, base space 27 is about 1.5 to about 2.5 times the cross-section of the wire used.

Outer arm space 25, between first outer arm 24 and first inner side 48 and between second outer arm 64 and second inner side 88 has measurements similar to base space 27.

The spacing for circle clip 90 and triangle clip 100 is similar to base space 27 with circle distance 96 measured from the diameter 98 and triangle distance 108 measured from the triangle base 110.

Basically, any wire capable of being bent and held in shape while retaining some spring capability, is suitable for use in forming this clip. A preferred wire cross-section is circular. Other cross-sections are operable so long as the sides are not injurious to the user. It is clear that in use, first inner grip 14 and second inner grip 18 may appear on one side of the articles desired to be held, while first outer grip 12 and second outer grip 16 are on the other side. This particular structure gives a very strong holding power while permitting the articles to be removed easily. Other gripping setups are also possible. A mere gripping of and pulling on flat top 22 and inner top 50 permits the clip to be removed from the articles easily.

Because of this disclosure and solely because of this disclosure, certain modifications of the clip disclosed and claimed herein can become obvious to a person of ordinary skill in this art. Such modifications are clearly covered hereby.

What is claimed and sought to be secured by Letters Patent of the United States is:

1. A continuous double-grip clip formed from a single and continuous piece of material having no ends and bent to form a first of pair gripping units to appear on one side of items desired to be gripped and a second pair of gripping units on an opposing side of said items, wherein:

a. said double-grip clip includes a first outer grip, a first inner grip substantially coplanar therewith and interior to said first outer grip, a second outer grip and second inner grip substantially coplanar therewith and interior to said second outer grip;

b. said first outer grip and said second inner grip are substantially coplanar;

c. said first outer grip is substantially a mirror image of said second outer grip;

d. said first inner grip is substantially a mirror image of said second inner grip;

e. said first outer grip and said second outer grip are joined by a substantially straight top;

f. a first outer device side is substantially perpendicular to said straight top at a first end of said top;

g. a first outer base is continuous from said first outer device side, is oppositely disposed from said straight top and is substantially parallel to said straight top;

h. a first interior arm is continuous from and substantially perpendicular to said first outer base, and is oppositely disposed from first outer device side;

i. said first inner grip includes a first inner leg connected to a first interior arm at a first inner arc;

j. said first inner leg is substantially parallel and adjacent to said first interior arm;

k. a first inner base is substantially perpendicular to said first inner leg and oppositely disposed from said first inner arc;

l. a first inner side is substantially perpendicular to said first inner base and oppositely disposed from said first inner leg;

m. a first inner top connects a second inner grip with said first inner grip;

n. a second outer device side extends from and is substantially perpendicular to said straight top;

o. a second outer base is perpendicular and oppositely disposed from said straight top as a continuing part of said second outer device side;

p. a second interior arm is oppositely disposed from said second outer device side and perpendicular to said second outer base;

q. a second inner arc is a continuation of said second interior arm and oppositely disposed from second outer base;

r. said second inner arc continues to form a second inner leg;

s. said second inner leg is between said second outer device side and said second interior arm; and t. a second inner base is substantially perpendicular to said second inner leg and oppositely disposed from said second inner arc.

2. The continuous double-grip clip of claim 1 wherein a space between said first interior arm and said second interior arm has measurements similar to the space between said flat top and said inner top

3. The continuous double-grip clip of claim 2 wherein said flat top is adjacent to and separated from said inner top by up to about twice the cross-section of material used to make said double-grip clip.

4. The continuous double-grip clip of claim 3 wherein said flat top is separated from said inner top by about 0.5 to about 1.5 times said cross-section.

5. The continuous double-grip clip of claim 4 wherein said flat top is separated from said inner top by about said cross-section.

6. The continuous double-grip clip of claim 2 wherein a space between said first outer arm and said first inner side is substantially similar to a space between said second outer arm and said second inner side, and is substantially similar to a space between said first outer base and said first inner base.

7. The continuous double-grip clip of claim 6 wherein a space between said first outer base and said first inner base is substantially similar to a space between second outer base and second inner base, and is up to about five times said cross-section.

8. The continuous double-grip clip of claim 7 wherein said space between said first outer base and said first inner base is about 1 to about 4 times said cross-section.

9. The continuous double-grip clip of claim 8 wherein said space between said first outer base and said first inner base is about 1.5 to about 2.5 times said cross-section and said cross-section is circular.

10. A continuous double-grip clip formed from a single and continuous piece of material having no ends and bent to form a first of pair gripping units to appear on one side of items desired to be gripped and a second pair of gripping units on an opposing side of said items, wherein:

a. said double-grip clip includes a first outer grip, a first inner grip substantially coplanar therewith and interior to said first outer grip, a second outer grip and second inner grip substantially coplanar therewith and interior to said second outer grip;

b. said first outer grip and said second inner grip are substantially coplanar;

c. said first outer grip is substantially a mirror image of said second outer grip;

d. said first inner grip is substantially a mirror image of said second inner grip;

e. said first outer grip and said second outer grip are joined by a substantially straight top;

f. a first outer device side is substantially perpendicular to said straight top at a first end of said top;

g. a first outer base is continuous from said first outer device side, is oppositely disposed from said straight top and is substantially parallel to said straight top;

h. a first interior arm is continuous from and substantially perpendicular to said first outer base, and is oppositely disposed from first outer device side;

i. said first inner grip includes a first inner leg connected to a first interior arm at a first inner arc;

j. said first inner leg is substantially parallel and adjacent to said first interior arm;

k. a first inner base is substantially arcuate and inwardly disposed toward but oppositely disposed from a first inner top, and between said first inner leg and said first interior arm;

l. a first inner side is substantially perpendicular to said first inner base and oppositely disposed from said first inner leg;
m. said first inner top connects a second inner grip with said first inner grip;
n. a second outer device side extends from and is substantially perpendicular to said straight top;
o. a second outer base is perpendicular and oppositely disposed from said straight top as a continuing part of said second outer device side;
p. a second interior arm is oppositely disposed from said second outer device side and perpendicular to said second outer base;
q. a second inner arc is a continuation of said second interior arm and oppositely disposed from second outer base;
r. said second inner arc continues to form a second inner leg;
s. said second inner leg is between said second outer device side and said second interior arm; and
t. a second inner base is substantially arcuate and inwardly disposed toward but oppositely disposed from said first inner top, and between said second inner side and said second interior arm.

11. The continuous double-grip clip of claim 10 wherein a space between said first interior arm and said second interior arm has measurements similar to the space between said flat top and said inner top.

12. The continuous double-grip clip of claim 11 wherein said flat top is adjacent to and separated from said inner top by up to about twice the cross-section of material used to make said double-grip clip.

13. The continuous double-grip clip of claim 12 wherein said flat top is separated from said inner top by about 0.5 to about 1.5 times said cross-section.

14. The continuous double-grip clip of claim 13 wherein said flat top is separated from said inner top by about said cross-section.

15. The continuous double-grip clip of claim 14 wherein a space between said first outer arm and said first inner side is substantially similar to a space between second outer arm and second inner side, and is substantially similar to a space between said first outer base and said first inner base.

16. The continuous double-grip clip of claim 15 wherein a space between said first outer base and said first inner base is substantially similar to a space between said second outer base and said second inner base, and is up to about five times said cross-section.

17. The continuous double-grip clip of claim 16 wherein said space between said first outer base and said first inner base is about 1 to about 4 times said cross-section.

18. The continuous double-grip clip of claim 17 wherein said space between said first outer base and said first inner base is about 1.5 to about 2.5 times said cross-section and said cross-section is circular.

19. A continuous double-grip clip formed from a single and continuous piece of material having no ends and bent to form a first of pair gripping units to appear on one side of items desired to be gripped and a second pair of gripping units on an opposing side of said items, wherein:

a. said double-grip clip includes a first outer grip, a first inner grip substantially coplanar therewith and interior to said first outer grip, a second outer grip and second inner grip substantially coplanar therewith and interior to said second outer grip;
b. said first outer grip and said second inner grip are substantially coplanar;
c. said first outer grip is substantially a mirror image of said second outer grip;
d. said first inner grip is substantially a mirror image of said second inner grip;
e. said first outer grip and said second outer grip are joined by a substantially straight top;
f. a first outer device side is substantially perpendicular to said straight top at a first end of said top;
g. a first outer base is continuous from said first outer device side, is oppositely disposed from said straight top and is substantially parallel to said straight top;
h. a first interior arm is continuous from and substantially perpendicular to said first outer base, and is oppositely disposed from first outer device side;
i. said first inner grip includes a first inner leg connected to a first interior arm at a first inner arc;
j. said first inner leg is substantially parallel and adjacent to said first interior arm;
k. a first inner base is substantially triangular and inwardly disposed toward but oppositely disposed from a first inner top, and between said first inner leg and said first interior arm;
l. a first inner side is substantially perpendicular to said first inner base and oppositely disposed from said first inner leg;
m. said first inner top connects a second inner grip with said first inner grip;
n. a second outer device side extends from and is substantially perpendicular to said straight top;
o. a second outer base is perpendicular and oppositely disposed from said straight top as a continuing part of said second outer device side;
p. a second interior arm is oppositely disposed from said second outer device side and perpendicular to said second outer base;
q. a ground inner arc is a continuation of said second interior arm and oppositely disposed from second outer base;
r. said second inner arc continues to form a second inner leg;
s. said second inner leg is between said second outer device side and said second interior arm;
t. a second inner base is substantially triangular and inwardly disposed toward but oppositely disposed from said first inner top, and between said second inner side and said second interior arm;
u. a space between said first outer arm and said first inner side is substantially similar to a space between second outer arm and second inner side, and is substantially similar to a space between said first outer base and said first inner base; and
v. a space between said first outer base and said first inner base is substantially similar to a space between second outer base and second inner base, and is up to about five times said cross-section.

20. The continuous double-grip clip of claim 19 wherein said flat top is adjacent to and separated from said inner top by about a cross-section of material used to make said double-grip clip; said space between said first outer base and said first inner base is about 1.5 to about 2.5 times said cross-section and said cross-section is circular.

* * * * *